US011479275B2

(12) United States Patent
Narita et al.

(10) Patent No.: US 11,479,275 B2
(45) Date of Patent: Oct. 25, 2022

(54) BOLSTER BEAM OF RAILCAR BOGIE

(71) Applicant: KAWASAKI RAILCAR MANUFACTURING CO., LTD., Hyogo (JP)

(72) Inventors: Tomohiro Narita, Nishinomiya (JP); Kazuo Isomura, Kobe (JP)

(73) Assignee: KAWASAKI RAILCAR MANUFACTURING CO., LTD., Kobe (JP)

( * ) Notice: Subject to any disclaimer, the term of this patent is extended or adjusted under 35 U.S.C. 154(b) by 412 days.

(21) Appl. No.: 16/706,835

(22) Filed: Dec. 9, 2019

(65) Prior Publication Data

US 2020/0108844 A1 Apr. 9, 2020

Related U.S. Application Data

(63) Continuation of application No. PCT/JP2018/017875, filed on May 9, 2018.

(30) Foreign Application Priority Data

Jun. 8, 2017 (JP) ..... JP2017-113198

(51) Int. Cl.

| | |
|---|---|
| ***B61F 5/10*** | (2006.01) |
| ***B61F 5/52*** | (2006.01) |
| ***B61F 5/04*** | (2006.01) |

(52) U.S. Cl.

CPC ..... *B61F 5/10* (2013.01); *B61F 5/04* (2013.01); *B61F 5/52* (2013.01)

(58) Field of Classification Search

CPC ..... B61F 5/00; B61F 5/02; B61F 5/04; B61F 5/06; B61F 5/08; B61F 5/10; B61F 5/12;

(Continued)

(56) References Cited

U.S. PATENT DOCUMENTS 3,400,668 A * 9/1968 Lich ..... B61F 5/14 105/199.1
4,760,799 A * 8/1988 Jackson ..... B61F 5/52 105/182.1

(Continued)

FOREIGN PATENT DOCUMENTS

CN 104494627 A * 4/2015 ..... B61F 5/02
JP 2007-112304 A 5/2007

(Continued)

*Primary Examiner* — Zachary L Kuhfuss
*Assistant Examiner* — Cheng Lin
(74) *Attorney, Agent, or Firm* — Xsensus LLP

(57) ABSTRACT

A bolster beam of a railcar bogie includes a bolster beam main body in which a pair of auxiliary air chambers respectively communicating with a pair of air springs are formed; and a stopper structure projecting upward from a car width direction middle portion of the bolster beam main body. An upper wall of the bolster beam main body includes a middle upper wall portion at which the stopper structure portion is provided; and a pair of outside upper wall portions adjacently located at both respective car width direction sides of the middle upper wall portion and joined to the middle upper wall portion. The pair of outside upper wall portions include respective upward bent portions that are located at a car width direction middle side and bent upward toward the stopper structure portion.

5 Claims, 6 Drawing Sheets

(58) Field of Classification Search
CPC .. B61F 5/127; B61F 5/14; B61F 5/144; B61F 5/16; B61F 5/50; B61F 5/52; B61F 5/22
See application file for complete search history.

(56) References Cited

U.S. PATENT DOCUMENTS

| | | | | | |
|---|---|---|---|---|---|
| 5,109,776 | A * | 5/1992 | Johnstone | ..... | B61F 5/14<br>105/200 |
| 9,545,933 | B2 * | 1/2017 | Nishimura | ..... | F16F 13/002 |
| 9,688,292 | B2 * | 6/2017 | Nishimura | ..... | B61F 5/20 |

FOREIGN PATENT DOCUMENTS

| | | | | | |
|---|---|---|---|---|---|
| JP | 4556836 | B2 * | 10/2010 | ..... | B61F 5/10 |
| KR | 20120121515 | A * | 11/2012 | ..... | B61F 5/50 |

* cited by examiner

BOLSTER BEAM OF RAILCAR BOGIE

CROSS-REFERENCE TO RELATED APPLICATIONS

The present application is a bypass continuation of PCT filing PCT/JP2018/017875, filed May 9, 2018, which claims priority to JP 2017-113198, filed Jun. 8, 2017, the entire contents of each are incorporated herein by reference.

TECHNICAL FIELD

The present invention relates to a bolster beam of a bogie supporting a car bodycar body of a railcar through a pair of air springs.

BACKGROUND Art

In a direct-mount bogie of a railcar, a bogie frame slidingly supports a bolster beam through side bearers, and the bolster beam supports a car body through air springs. As one example of the bolster beam, there is a bolster beam in which an auxiliary air chamber communicating with an air spring is formed.

SUMMARY OF INVENTION

Technical Problem

Since a car body load is applied from the air springs to the bolster beam, and reaction force is applied from the side bearers to the bolster beam, the bolster beam is required to have predetermined strength. Especially, when the air springs and the side bearers are arranged so as to be displaced from each other in a car width direction, the inventors have determined that a large bending stress acts on the bolster beam. The bolster beam is provided with a stopper structure configured to restrict the positional displacement of the bolster beam relative to the car body within the predetermined range. Therefore, when the interference member of the car body acts on the stopper structure, the inventors have determined that a large stress is momentarily generated at the bolster beam.

The stopper structure projects upward from an upper wall of a bolster beam main body extending in the car width direction. Therefore, the load acts on a joined portion where the stopper structure and the bolster beam main body are joined to each other, so as to bend this joined portion. The inventors have determined that the stress concentrates on the joined portion.

Solution to Problem

A bolster beam of a railcar bogie according to one aspect of the present invention is a bolster beam of a railcar bogie supporting a car body of a railcar through a pair of air springs, the bolster beam including: a bolster beam main body portion including an upper wall and a lower wall and extending in a car width direction, a pair of auxiliary air chambers being formed in the bolster beam main body portion, the pair of auxiliary air chambers communicating with the respective air springs; and a stopper structure portion including a stopper plate, the stopper plate projecting upward from a car width direction middle portion of the bolster beam main body portion and configured to restrict positional displacement of the bolster beam relative to the car body in a horizontal direction within a predetermined range. The upper wall of the bolster beam main body portion includes: a middle upper wall portion at which the stopper structure portion is provided; and a pair of outside upper wall portions adjacently located at both respective car width direction sides of the middle upper wall portion and joined to the middle upper wall portion. The pair of outside upper wall portions include respective upward bent portions that are located at a car width direction middle side and bent upward toward the stopper structure portion. Inner end portions of the pair of outside upper wall portions are joined to the middle upper wall portion, the inner end portions being located closer to the stopper structure portion than the corresponding upward bent portions.

According to the above configuration, even if bending stress is generated at the bolster beam, and the stress concentrates on the upward bent portion of the upper wall of the bolster beam main body portion, the stress can be prevented from concentrating on a joined portion where the outside upper wall portion and the middle upper wall portion are joined to each other. This is because the joined portion is located at a position displaced from the upward bent portion toward the car width direction middle side. Therefore, the strength of the bolster beam can be improved while making the bolster beam thin and lightweight.

DESCRIPTION OF EMBODIMENTS

Hereinafter, embodiments will be described with reference to the drawings. In the following description, a direction in which a car travels is defined as a car longitudinal direction (front-rear direction), and a lateral direction perpendicular to the car longitudinal direction is defined as a car width direction (left-right direction).

Embodiment 1

Figure 1:
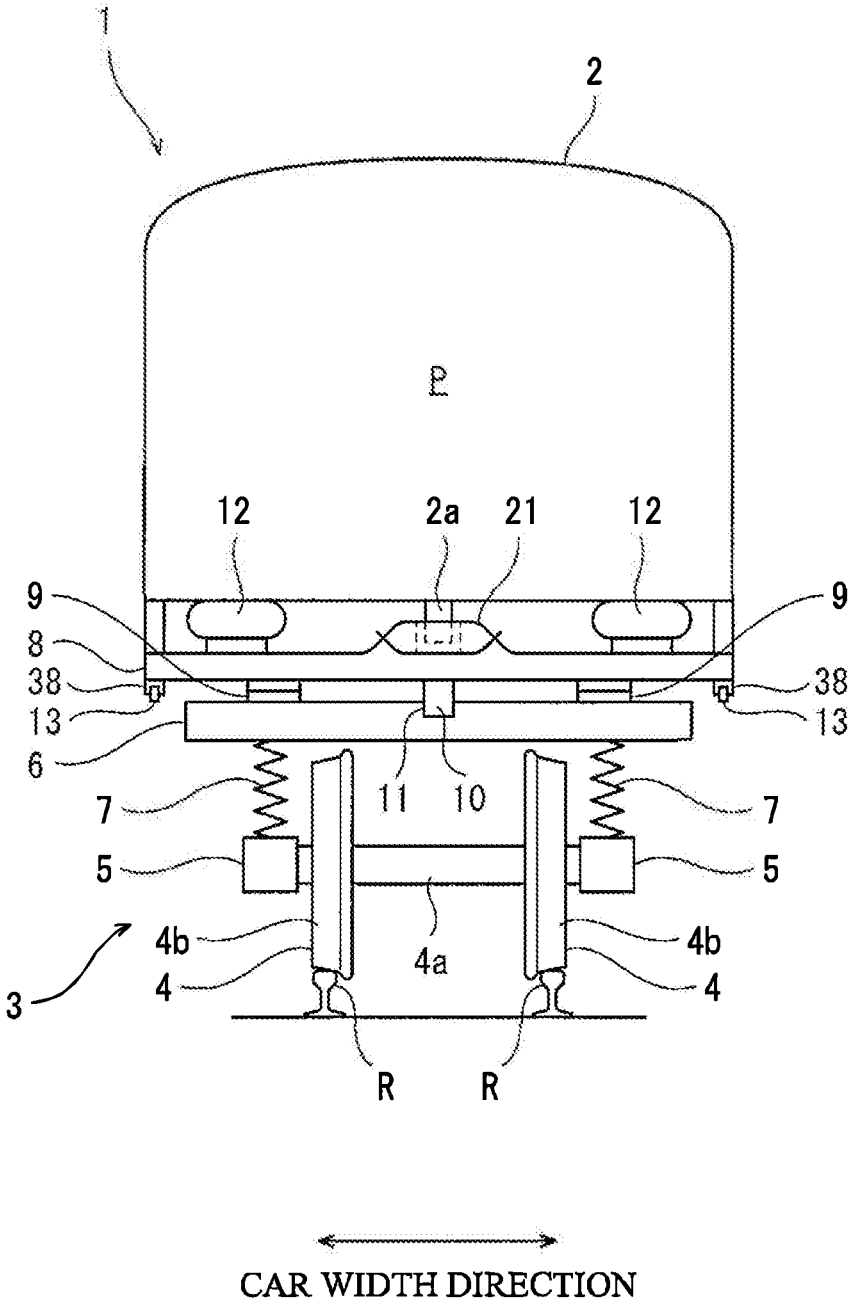
FIG. 1 is a front view of a railcar equipped with a bogie including a bolster beam according to Embodiment 1.

FIG. 1 is a front view of a railcar 1 equipped with a bogie 3 including a bolster beam 8 according to Embodiment 1. As shown in FIG. 1, the railcar 1 includes: a car body 2 including a passenger room P; and the bogie 3 supporting the car body 2. The bogie 3 is a direct-mount bolster-equipped bogie. The bogie 3 includes a wheelset 4 that rolls on rails R. The wheelset 4 includes an axle 4*a* and a pair of wheels 4*b*. The axle 4*a* extends in the car width direction. The pair of wheels 4*b* are provided at both respective axial side portions of the axle 4*a*. Both end portions of the axle 4*a* are supported by respective axle boxes 5 such that the axle 4*a* is rotatable. The axle boxes 5 accommodate respective bearings. A bogie frame 6 is arranged above the axle boxes 5. The bogie frame 6 is supported by the axle boxes 5 through primary suspensions 7 (coil springs, for example).

The bolster beam 8 (bolster) extending in the car width direction is arranged above the bogie frame 6. The bolster beam 8 is slidingly supported by the bogie frame 6 through a pair of side bearers 9 spaced apart from each other in the car width direction. The bolster beam 8 includes a center pin 10 projecting downward from a middle portion thereof in a car width direction. The center pin 10 is supported by a center plate 11 so as to be turnable in a yawing direction. The center plate 11 is provided at the bogie frame 6. A pair of air springs 12 (secondary suspensions) are mounted on respective upper surfaces of both car width direction side portions of the bolster beam 8. To be specific, the bolster beam 8 supports the car body 2 through the pair of air springs 12. The pair of air springs 12 are located outside the pair of side bearers 9 in the car width direction.

Both car width direction end portions of the bolster beam 8 are connected to the car body 2 through bolster anchors 13 at positions outside the air springs 12 in the car width direction. A tractive effort of the bogie 3 is transmitted from the bolster beam 8 through the bolster anchors 13 to the car body 2. A stopper structure portion 21 projecting upward is provided at the car width direction middle portion of the bolster beam 8. An interference member 2*a* projects downward from the car body 2, and the stopper structure portion 21 is opposed to the interference member 2*a* with a gap or space in a horizontal direction. The interference member 2*a* is a protrusion which is connected to the car body, either directly or through an intermediate structure such as a bracket or beam. The stopper structure portion 21 restricts positional displacement of the bolster beam 8 relative to the car body 2 in the horizontal direction (mainly in the left-right direction) within a predetermined range. According to one implementation, the interference member 2*a* does not restrict vertical displacement of the bolster beam 8 relative to the car body in the car width direction.

Figure 2:
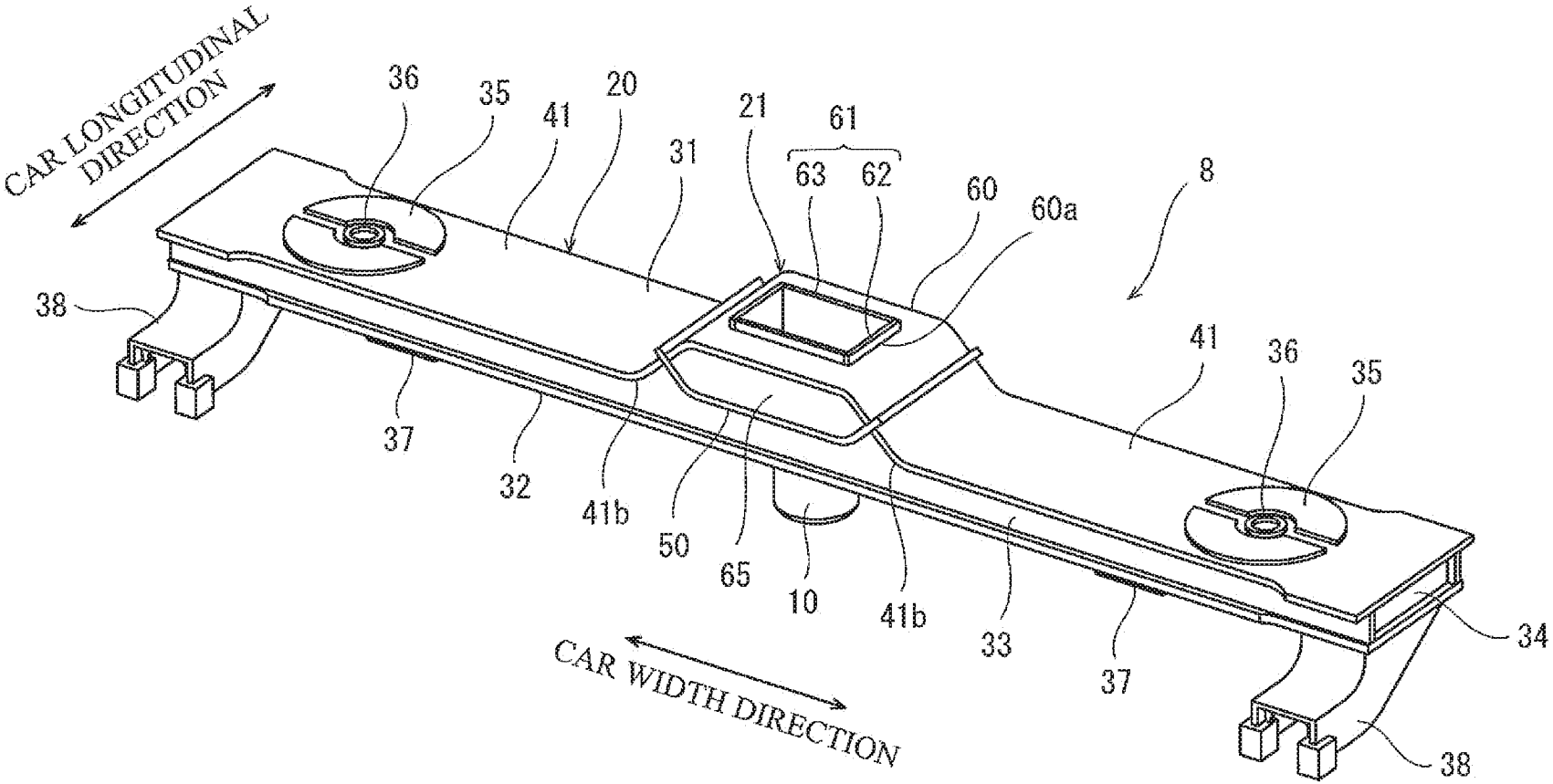
FIG. 2 is a perspective view of the bolster beam shown in FIG. 1.
Figure 3:
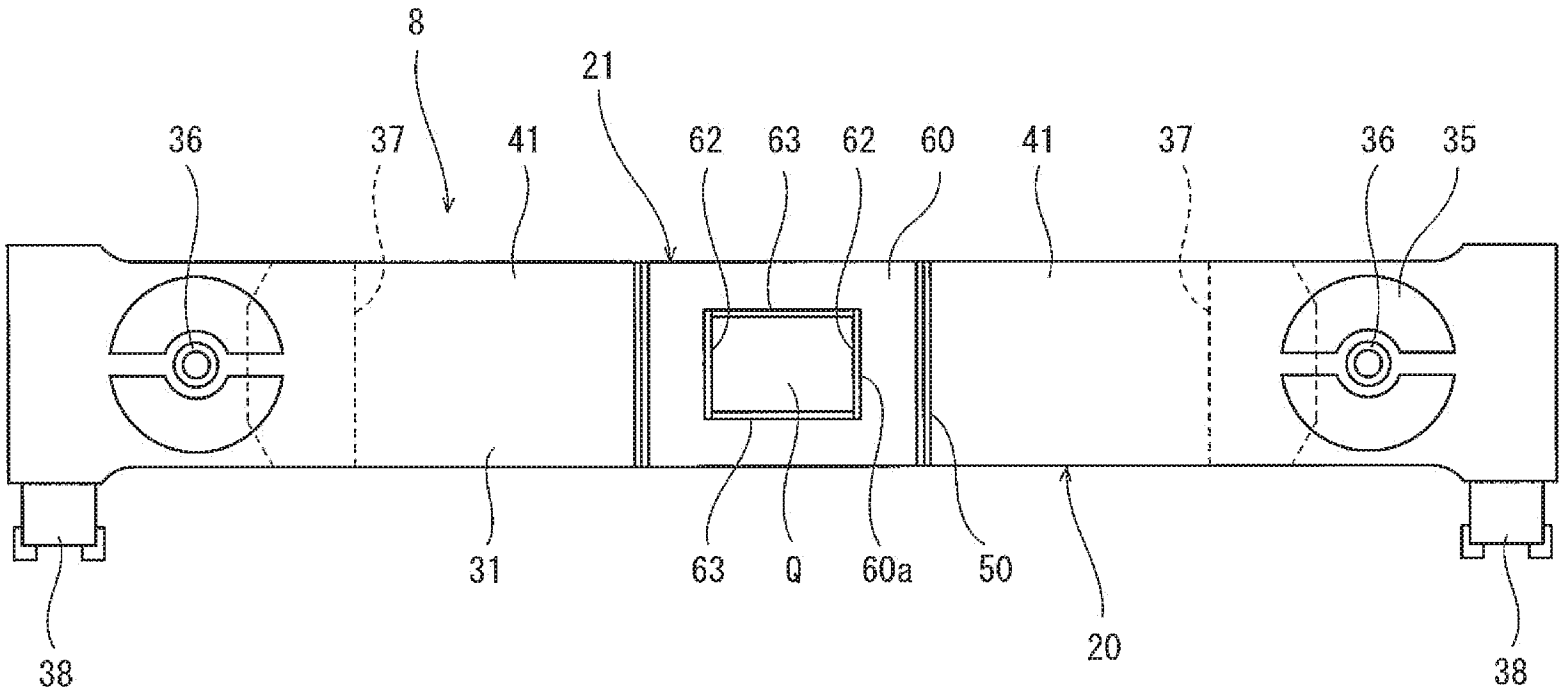
FIG. 3 is a plan view of the bolster beam of FIG. 1 when viewed from above.
Figure 4:
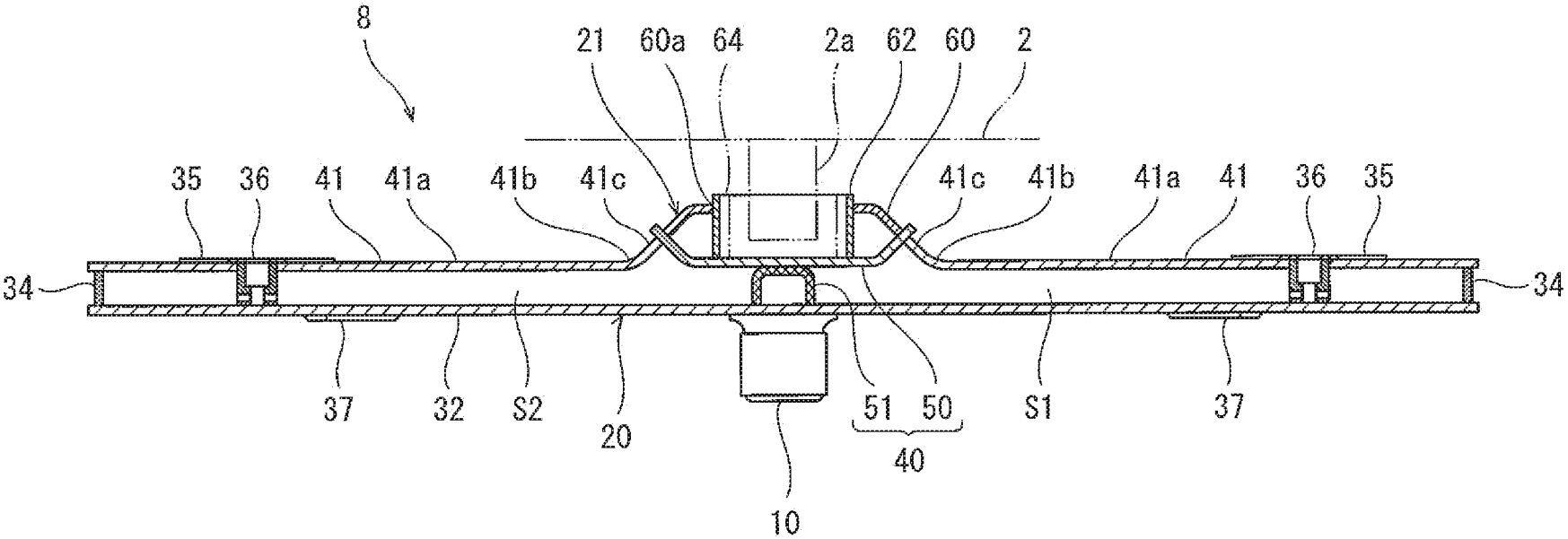
FIG. 4 is a longitudinal sectional view of the bolster beam of FIG. 1 when viewed from a car longitudinal direction.
Figure 5:
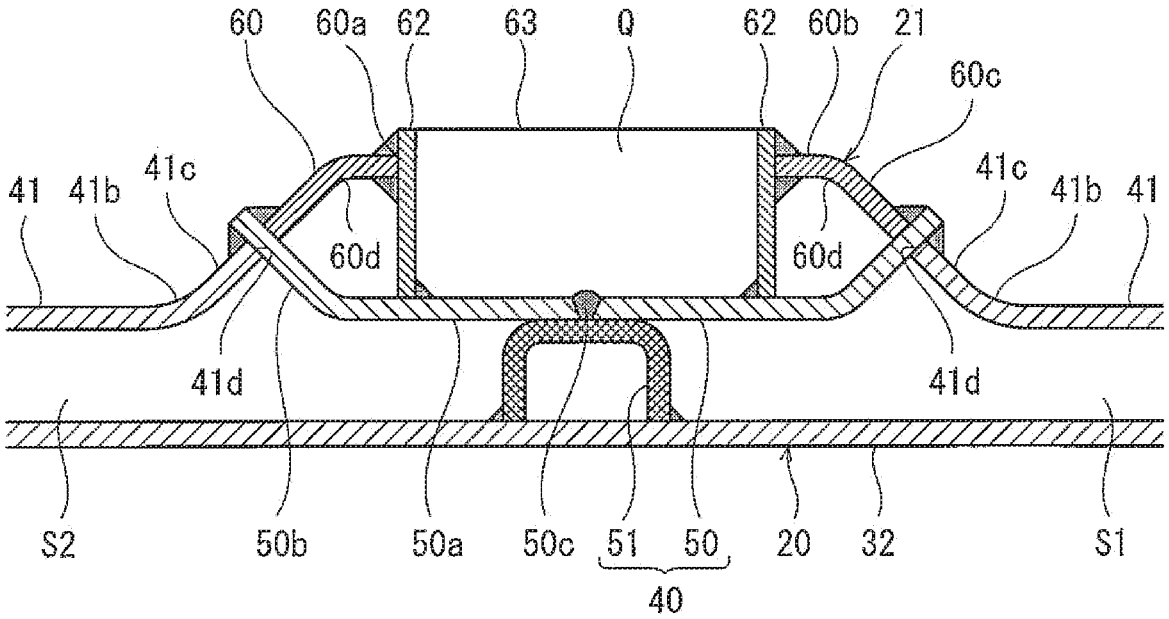
FIG. 5 is an enlarged sectional view of major components of FIG. 4.

FIG. 2 is a perspective view of the bolster beam 8 shown in FIG. 1. FIG. 3 is a plan view of the bolster beam 8 of FIG. 1 when viewed from above. FIG. 4 is a longitudinal sectional view of the bolster beam 8 of FIG. 1 when viewed from the car longitudinal direction. FIG. 5 is an enlarged sectional view of major components of FIG. 4. As shown in FIGS. 2 to 5, the bolster beam 8 includes a bolster beam main body portion 20 and the stopper structure portion 21. The bolster beam main body portion 20 extends in the car width direction and has a substantially rectangular solid shape. The stopper structure portion 21 projects upward from a car width direction middle portion of the bolster beam main body portion 20. The bolster beam 8 is formed by welding a plurality of metal plates together. The bolster beam main body portion 20 includes therein a pair of auxiliary air chambers S1 and S2. The auxiliary air chambers S1 and S2 are airtight spaces communicating with the respective air springs 12 (see FIG. 1).

The bolster beam main body portion 20 includes an upper wall 31, a lower wall 32, a pair of long-side walls 33, and a pair of short-side walls 34. The upper wall 31 and the lower wall 32 are spaced apart from each other in a vertical direction and extend in the car width direction. One of the pair of long-side walls 33 couples one of car longitudinal direction end portions of the upper wall 31 and one of car longitudinal direction end portions of the lower wall 32 to each other, and the other of the pair of long-side walls 33 couples the other car longitudinal direction end portion of the upper wall 31 and the other car longitudinal direction end portion of the lower wall 32 to each other. One of the pair of short-side walls 34 couples one of car width direction end portions of the upper wall 31 and one of car width direction end portions of the lower wall 32 to each other, and the other of the pair of short-side walls 34 couples the other car width direction end portion of the upper wall 31 and the other car width direction end portion of the lower wall 32 to each other.

A pair of air spring placing portions 35 on which the pair of air springs 12 (see FIG. 1) are respectively placed are provided at both respective car width direction side portions of the upper wall 31 of the bolster beam main body portion 20. Channel tubes 36 penetrating the upper wall 31 are provided at respective centers of the air spring placing portions 35. The channel tubes 36 make compressed air spaces of the air springs 12 airtightly communicate with the corresponding auxiliary air chambers S1 and S2 of the bolster beam main body portion 20. The stopper structure portion 21 is provided at a car width direction middle portion of the upper wall 31 of the bolster beam main body portion 20. The stopper structure portion 21 includes a stopper 61 which is opposed to the interference member 2*a*, projecting downward from the car body 2, with a gap in the horizontal direction.

A pair of rubbing plates 37 are fixed to the lower wall 32 of the bolster beam main body portion 20. The pair of rubbing plates 37 are slidingly supported by a pair of side bearers 9 (see FIG. 1) provided on an upper surface of the bogie frame 6. The pair of rubbing plates 37 are arranged away from each other in the car width direction and are arranged inside the air spring placing portions 35 in the car width direction. To be specific, positions where downward car body load is applied from the air springs 12 to the bolster beam main body portion 20 and positions where upward reaction force is applied from the side bearers 9 of the bogie frame 6 to the bolster beam main body portion 20 are displaced from each other in the car width direction.

A pair of bolster anchor brackets 38 are fixed to both respective car width direction end portions of the lower wall 32 of the bolster beam main body portion 20 so as to be located outside the air spring placing portions 35 in the car width direction. The bolster anchors 13 (see FIG. 1) are attached to the respective bolster anchor brackets 38. The center pin 10 projecting downward from the lower wall 32 is fixed to a car width direction middle portion of the lower wall 32 of the bolster beam main body portion 20.

The upper wall 31 of the bolster beam main body portion 20 is formed by a middle member 40 and a pair of outside upper wall portions 41. The stopper structure portion 21 is provided at the middle member 40. The pair of outside upper wall portions 41 are adjacently located at both respective car width direction sides of the middle member 40 and are welded to the middle member 40. Each of the outside upper wall portions 41 is longer than the middle member 40 in the car width direction. Each of the outside upper wall portions 41 include a flat plate portion 41*a*, an upward bent portion 41*b*, and an inclined portion 41*c* (inner end portion). The flat plate portion 41*a* has a normal line extending in the vertical direction, and the air spring placing portion 35 is provided at the flat plate portion 41*a*. The upward bent portion 41*b* is located at a car width direction middle side of the flat plate portion 41*a* and is bent diagonally upward toward the stopper structure portion 21. The inclined portion 41*c* (inner end portion) extends linearly and diagonally upward from the upward bent portion 41*b*. The inclined portion 41*c* is shorter than the flat plate portion 41*a* in the car width direction and shorter than a stopper plate 62 in the vertical direction. The inclined portion 41*c* is welded to a below-described middle upper wall portion 50 of the middle member 40 at a position higher than the flat plate portion 41*a*.

The middle member 40 includes the middle upper wall portion 50 and a partition plate portion 51. The middle upper wall portion 50 is welded to the inclined portions 41*c* of the pair of outside upper wall portions 41 and closes a space formed between the pair of outside upper wall portions 41. To be specific, the upper wall 31 of the bolster beam main body portion 20 is constituted by the middle upper wall portion 50 and the pair of outside upper wall portions 41. The stopper structure portion 21 is welded to the middle upper wall portion 50 from above. The partition plate portion 51 is arranged between the middle upper wall portion 50 and the lower wall 32. The partition plate portion 51, the middle upper wall portion 50, and the lower wall 32 are integrated with each other by being joined to each other. With this, the partition plate portion 51 airtightly separates the pair of auxiliary air chambers S1 and S2, arranged at left and right sides of the partition plate portion 51, from each other. To be specific, each of the auxiliary air chambers S1 and S2 is an airtight space surrounded by the middle upper wall portion 50, the outside upper wall portion 41, the partition plate portion 51, the lower wall 32, the pair of long-side walls 33, and the short-side wall 34.

The stopper structure portion 21 includes a cover plate 60 and the stopper 61. Both car width direction end portions of the cover plate 60 are welded to the middle upper wall portion 50. By welding the cover plate 60 to the middle upper wall portion 50, an opening that is open toward the car longitudinal direction is formed, but closing plates 65 configured to close this opening are welded to the middle upper wall portion 50 and the cover plate 60. An opening 60*a* that is open in the vertical direction is formed at a middle of the cover plate 60. The stopper 61 is inserted into the opening 60*a* in the vertical direction, and in this state, welded to the middle upper wall portion 50 and the cover plate 60. The stopper 61 includes a pair of stopper plates 62 and a pair of stopper plates 63. The pair of stopper plates 62 are opposed to each other with a gap in the car width direction. The pair of stopper plates 63 are opposed to each other with a gap in the car longitudinal direction. The stopper plates 62 and 63 form a rectangular tube shape as a whole, and a stopper space Q into which the interference member 2*a* is inserted is formed at an inner side (middle side) of the rectangular tube shape. The stopper plates 62 and 63 may each be planar, but the stopper plates can also be implemented to have a curved or non-planar structure, or any combination of planar and curved or non-planar structure may be used. Cushioning bodies 64 (for example, elastic bodies, such as rubber) are fixed to inner surfaces of the stopper plates 62, the inner surfaces being opposed to the interference member 2*a*. Bolt holes used to fix the cushioning bodies 64 are formed on the stopper plates 62. To be specific, a space surrounded by the middle upper wall portion 50, the cover plate 60, the stopper 61, and the below-described closing plates 65 is a non-airtight space. The stopper plates 63 restrict the positional displacement of the bolster beam 8 relative to the car body in the car longitudinal direction when the bolster anchor 13 breaks. The cushioning bodies 64 may also be provided on inner surfaces of the stopper plates 63.

As shown in FIG. 5, the partition plate portion 51 is constituted by a metal plate having an inverted U-shaped section, and a lower end portion of the partition plate portion 51 is welded to the lower wall 32. The middle upper wall portion 50 includes a first part 50*a* and a pair of second parts 50*b* provided at both respective car width direction sides of the first part 50*a*. The first part 50*a* is a flat plate portion extending horizontally and includes a slit 50*c*. The slit 50*c* extends in the car longitudinal direction at a position corresponding to the partition plate portion 51. The middle upper wall portion 50 is welded to the partition plate portion 51 from above through the slit 50*c*. Each of the second parts 50*b* extends diagonally upward from the first part 50*a* to an outer side in the car width direction. To be specific, the first part 50*a* is located lower than the second parts 50*b*.

A normal line of an end surface 41*d*, located at a car width direction middle side, of the inclined portion 41*c* of the outside upper wall portion 41 extends diagonally upward at the car width direction middle side. To be specific, the normal line contains a vertically upward component. A car width direction end portion of each second part 50*b* of the middle upper wall portion 50 is placed on the end surface 41*d* of the outside upper wall portion 41 from above, and in this state, projects outward in the car width direction beyond the end surface 41*d* of the outside upper wall portion 41. In this state, the car width direction end portion of each second part 50*b* of the middle upper wall portion 50 is welded to the inclined portion 41*c* of the outside upper wall portion 41 from an outside. Car longitudinal direction end portions of the middle upper wall portion 50 are placed on respective upper end surfaces of the long-side walls 33, and in this state, welded to the long-side walls 33 from an outside (see FIG. 2).

The cover plate 60 includes a horizontal plate portion 60*b*, a pair of inclined portions 60*c* (outer end portions), and downward bent portions 60*d*. The horizontal plate portion 60*b* includes the opening 60*a* and extends in the horizontal direction. The pair of inclined portions 60*c* (outer end portions) extend diagonally downward from the horizontal plate portion 60*b* to the respective outside upper wall portions 41 located at both sides in the car width direction. Each of the downward bent portions 60*d* is formed between the horizontal plate portion 60*b* and the inclined portion 60*c* and is bent downward. The stopper plates 62 and 63 are inserted into the opening 60*a* of the horizontal plate portion 60*b* in the vertical direction. Upper end portions of the stopper plates 62 project upward beyond the horizontal plate portion 60*b* of the cover plate 60. Upper end portions of the stopper plates 62 and 63 are welded to the horizontal plate portion 60*b* of the cover plate 60 at the rim of the opening 60*a*.

A lower end surface of each inclined portion 60*c* of the cover plate 60 contacts an upper surface of the second part 50*b* of the middle upper wall portion 50, and lower end surfaces of the stopper plates 62 and 63 contact an upper surface of the first part 50*a* of the middle upper wall portion 50. The second parts 50*b* of the middle upper wall portion 50 project outward in the car width direction beyond the cover plate 60. A lower end portion of each inclined portion 60*c* of the cover plate 60 is welded to the second part 50*b* of the middle upper wall portion 50 from an outside. To be specific, portions of the cover plate 60 which portions are located closer to the corresponding outside upper wall portions 41 than the corresponding downward bent portions 60*d* are joined to the middle upper wall portion 50.

The lower end portions of the stopper plates 62 and 63 are welded to the first part 50*a* of the middle upper wall portion 50 from the stopper space Q side. Each inclined portion 60*c* of the cover plate 60 is arranged on the same straight line as the corresponding inclined portion 41*c* of the outside upper wall portion 41. To be specific, the middle upper wall portion 50 is sandwiched by the inclined portions 60*c* of the cover plate 60 and the inclined portions 41*c* of the outside upper wall portions 41.

A procedure of manufacturing the bolster beam 8 is described below. First, the bolster beam main body portion 20 to which the cover plate 60 and the stopper plates 62 and 63 are not welded yet is manufactured. In the bolster beam main body portion 20, the middle upper wall portion 50 is welded to the partition plate portion 51 and the outside upper wall portions 41, and with this, airtight structures of the auxiliary air chambers S1 and S2 are realized. Therefore, at this stage (i.e., before the cover plate 60 and the stopper plates 62 and 63 are welded to the bolster beam main body portion 20), an airtight test of the auxiliary air chambers S1 and S2 is performed. In the airtight test, compressed air is airtightly supplied from the channel tubes 36 of the air spring placing portions 35 to the auxiliary air chambers S1 and S2, and whether or not air is leaking at the bolster beam main body portion 20 is inspected.

If the bolster beam main body portion 20 fails the airtight test, an air leak portion is repaired, and the airtight test is performed again. After it is confirmed that the bolster beam main body portion 20 passes the airtight test, the cover plate 60, the stopper plates 62 and 63, and the closing plates 65 which are assembled in advance are welded to the bolster beam main body portion 20. To be specific, the cover plate 60, the stopper plates 62 and 63, and the closing plates 65 are welded to each other before being welded to the bolster beam main body portion 20. As above, since the airtight test of the bolster beam main body portion 20 to which the stopper structure portion 21 is not welded yet is performed, repair work is easily performed even if the bolster beam main body portion 20 fails the airtight test. Further, since an airtight structure portion and a non-airtight structure portion can be manufactured simultaneously, work efficiency can be improved.

According to the above-explained configuration, the car body load applied to the pair of air spring placing portions 35 acts on the bolster beam 8 in a state where the rubbing plates 37 supported by the side bearers 9 serve as fulcrums. With this, bending stress is generated at the bolster beam 8. A joined portion where the outside upper wall portion 41 and the middle upper wall portion 50 of the middle member 40 are joined to each other is located at a position displaced from the upward bent portion 41*b* toward the car width direction middle side. Therefore, even if the stress concentrates on the upward bent portion 41*b* of the upper wall 31 of the bolster beam main body portion 20, a stress concentration portion can be set at the flat plate portion 41*a* (base material portion) having high fatigue strength, not the joined portion having low fatigue strength. On this account, the strength of the bolster beam can be increased while preventing an increase in reinforcement of the bolster beam and an increase in thickness of the bolster beam.

The middle upper wall portion 50 constituting the upper wall 31 of the bolster beam main body portion 20 and provided with the stopper structure portion 21 is welded to the lower wall 32 of the bolster beam main body portion 20 by the partition plate portion 51 configured to separate the pair of auxiliary air chambers S1 and S2 from each other. Therefore, the rigidity improves by the rib effect of the partition plate portion 51, and this improves the stability of the stopper structure portion 21 provided at the middle upper wall portion 50.

The middle upper wall portion 50 has such a shape that the first part 50*a* welded to the partition plate portion 51 and the stopper plates 62 and 63 is located lower than the pair of second parts 50*b* welded to the pair of outside upper wall portions 41. Therefore, positions where the stopper plates 62 and 63 are welded to the middle upper wall portion 50 are made low. On this account, the height of the stopper structure portion 21 can be made low, and this improves the degree of freedom of space. Then, the first part 50*a* of the middle upper wall portion 50 extends in the horizontal direction, and the second parts 50*b* of the middle upper wall portion 50 extend diagonally upward from the first part 50*a* to both respective car width direction sides. Therefore, the degree of freedom of space can be improved while forming the middle upper wall portion 50 in a simple shape that is easy to manufacture.

The normal line of the end surface 41*d*, located at the car width direction middle side, of each of the pair of outside upper wall portions 41 contains the vertically upward component. Therefore, when welding the middle upper wall portion 50 of the middle member 40 and the pair of outside upper wall portions 41, the middle upper wall portion 50 can be placed on the end surfaces 41*d*, facing upward, of the pair of outside upper wall portions 41. Thus, the weldability improves. The stopper plates 62 and 63 are inserted in the vertical direction into the opening 60*a* of the cover plate 60 welded to the bolster beam main body portion 20, and in this state, connected to the bolster beam main body portion 20 and welded to the cover plate 60. Therefore, the stopper plates 62 and 63 are strongly supported, and the stability of the stopper structure portion 21 improves.

Each inclined portion 60*c* of the cover plate 60 is arranged on the same straight line as the corresponding inclined portion 41*c* located at the car width direction middle side of the upward bent portion 41*b* in the outside upper wall portion 41. The stress acting on the bolster beam main body portion 20 and the stopper structure portion 21 is smoothly transmitted between the bolster beam main body portion 20 and the stopper structure portion 21 through the inclined portions 41*c* and 60*c*. Therefore, the strength of the bolster beam 8 improves as a whole.

Embodiment 2

Figure 6:
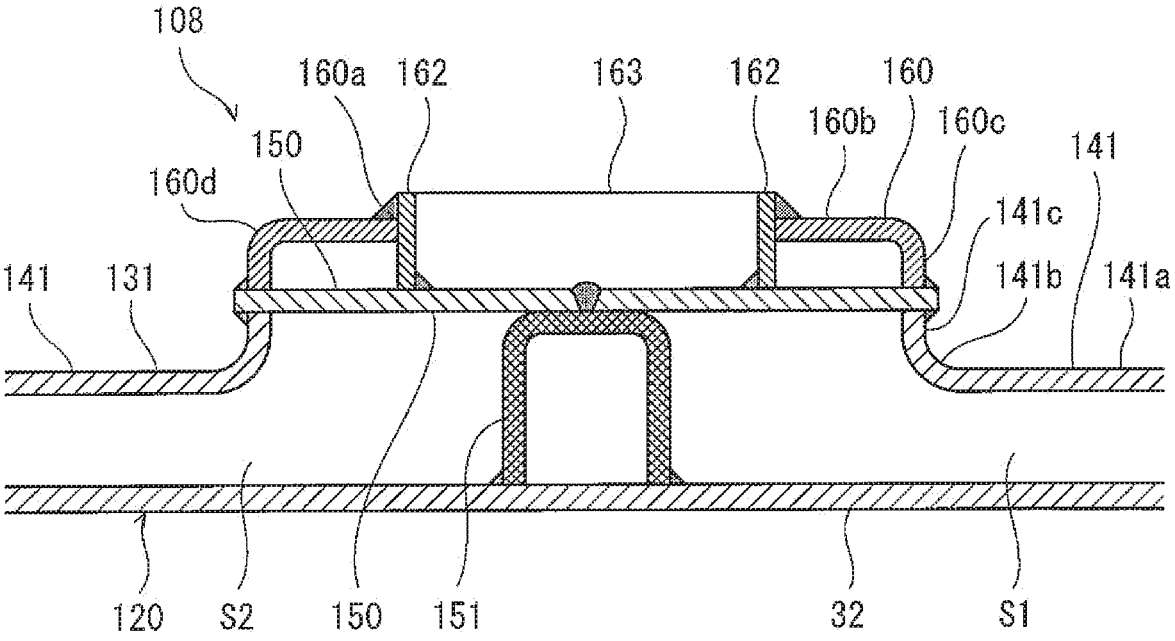
FIG. 6 is a diagram of the bolster beam according to Embodiment 2 and corresponds to FIG. 5.

FIG. 6 is a diagram showing a bolster beam 108 according to Embodiment 2 and corresponds to the view of FIG. 5. As shown in FIG. 6, in the bolster beam 108 of Embodiment 2, a middle upper wall portion 150 of an upper wall 131 of a bolster beam main body portion 120 is a horizontal plate. Each of outside upper wall portions 141 of the upper wall 131 of the bolster beam main body portion 120 includes a flat plate portion 141*a*, an upward bent portion 141*b*, and a vertical portion 141*c* (end portion). The air spring placing portion 35 (see FIG. 2) is provided at the flat plate portion 141*a*. The upward bent portion 141*b* is bent upward in the vertical direction at the car width direction middle side of the flat plate portion 141*a*. The vertical portion 141*c* (end portion) extends linearly and upward in the vertical direction from the upward bent portion 141*b*.

An upper end of the partition plate portion 151 is located higher than the flat plate portions 141*a*. A cover plate 160 includes a horizontal portion 160*b* and a pair of vertical portions 160*c*. The horizontal portion 160*b* includes an opening 160*a* into which stopper plates 162 and 163 are inserted. The pair of vertical portions 160*c* extend downward from both respective car width direction sides of the horizontal portion 160*b*. Each of both car width direction end portions of the middle upper wall portion 150 is sandwiched by the vertical portion 160*c* of the cover plate 160 and the vertical portion 141*c* of the outside upper wall portion 141 in the vertical direction. Since the other components are the same as those in Embodiment 1, explanations thereof are omitted.

Embodiment 3

Figure 7:
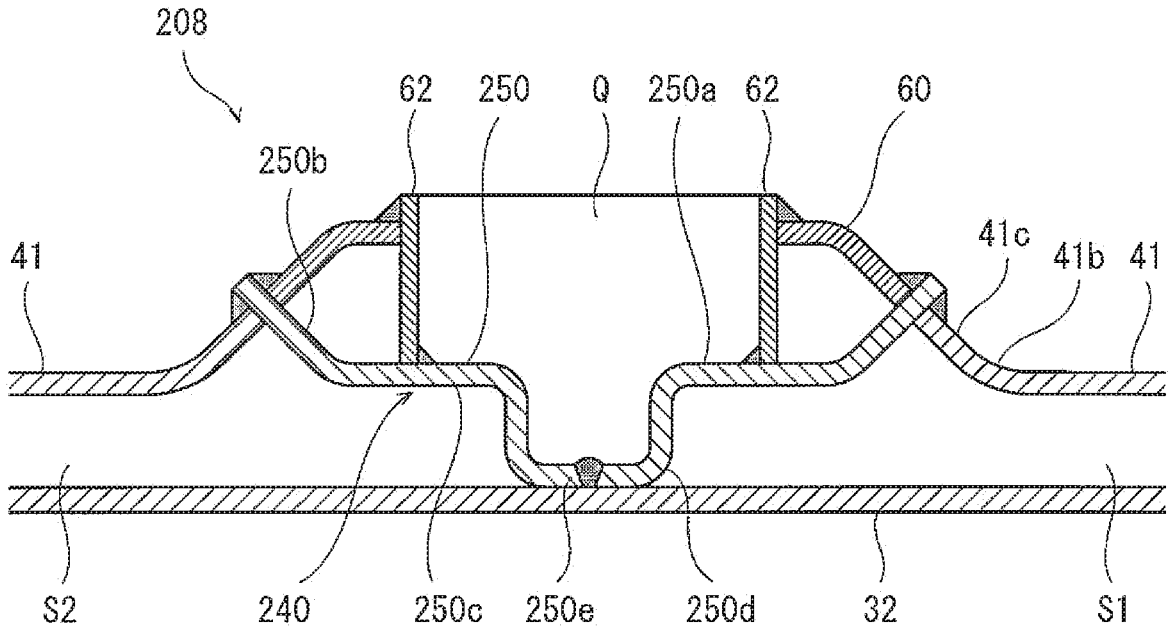
FIG. 7 is a diagram of the bolster beam according to Embodiment 3 and corresponds to FIG. 5.

FIG. 7 is a diagram of a bolster beam 208 according to Embodiment 3 and corresponds to the view of FIG. 5. As shown in FIG. 7, in the bolster beam 208 of Embodiment 3, a middle upper wall portion 250 and a partition plate portion 250*d* constituting a middle member 240 are constituted by a metal plate subjected to bending. The middle upper wall portion 250 includes a first part 250*a* and a pair of second parts 250*b* provided at both respective car width direction sides of the first part 250*a*. The first part 250*a* includes a pair of horizontal portions 250*c* and the partition plate portion 250*d*. The pair of horizontal portions 250*c* extend from the pair of second parts 250*b* toward the car width direction middle side. The partition plate portion 250*d* projects downward from car width direction middle side end portions of the pair of horizontal portions 250*c* and has a concave section.

A slit 250*e* extending in the car longitudinal direction is formed at a bottom wall portion of the partition plate portion 250*d*. The slit 250*e* is exposed to the stopper space Q. The partition plate portion 250*d* is welded to the lower wall 32 through the slit 250*e* from above. Each of the second parts 250*b* extends diagonally upward from the first part 250*a* to an outer side in the car width direction and is welded to the inclined portion 41*c* of the outside upper wall portion 41. Since the other components are the same as those in Embodiment 1, explanations thereof are omitted.

Embodiment 4

Figure 8:
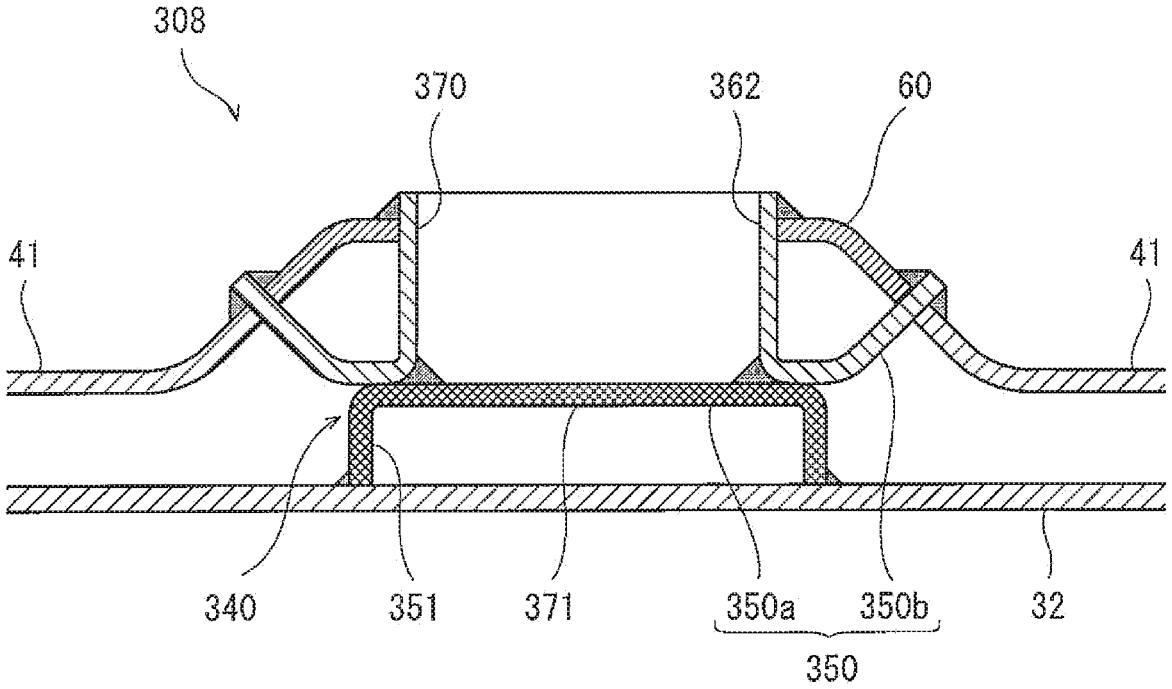
FIG. 8 is a diagram of the bolster beam according to Embodiment 4 and corresponds to FIG. 5.

FIG. 8 is a diagram of a bolster beam 308 according to Embodiment 4 and corresponds to the view of FIG. 5. As shown in FIG. 8, in the bolster beam 308 of Embodiment 4, a second parts 350*b* of a middle upper wall portion 350 and a stopper plate 362 are constituted by a first metal plate 370 subjected to bending. A first part 350*a* of the middle upper wall portion 350 and partition plate portions 351 are constituted by a second metal plate 371 subjected to bending and having an inverted concave section. The first metal plate 370 is welded to the second metal plate 371 at a lower end portion of the stopper plate 362. To be specific, a middle member 340 is constituted by the first and second metal plates 370 and 371 welded to each other, and the middle upper wall portion 350 is constituted by the first part 350*a* of the second metal plate 371 and the second parts 350*b* of the first metal plates 370. Since the other components are the same as those in Embodiment 1, explanations thereof are omitted.

The present invention is not limited to the above embodiments, and modifications, additions, and eliminations may be made with respect to the configuration(s) of the embodiment(s). The above embodiments may be combined arbitrarily. For example, some of components or methods in one embodiment may be applied to another embodiment. Some of components in an embodiment may be separated and extracted arbitrarily from the other components in the embodiment. The bogie may be configured to use, as a primary suspension, a plate spring which also serves as a side sill of a bogie frame. To be specific, the bogie may be configured such that: both longitudinal direction end portions of each of plate springs are supported by a pair of front and rear axle boxes; and longitudinal direction middle portions of the plate springs support a cross beam of the bogie frame from below.

REFERENCE SIGNS LIST

1 railcar
2 car body
2*a* interference member
3 bogie
6 bogie frame
8, 108, 208, 308 bolster beam
9 side bearer
12 air spring
20, 120 bolster beam main body portion
21 stopper structure portion
31, 131 upper wall
32 lower wall
35 air spring placing portion
37 rubbing plate
41, 141 outside upper wall portion
41*a*, 141*a* flat plate portion
41*b*, 141*b* upward bent portion
41*c* inclined portion (inner end portion)
41*d* end surface
50, 150, 250, 350 middle upper wall portion
50*a*, 250*a* first part
50*b*, 250*b*, 350*b* second part
51, 151, 250*d* partition plate portion
60, 160 cover plate
60*a* opening
60*b*, 160*b* horizontal plate portion
60*c*, 160*c* inclined portion (outer end portion)
60*d* downward bent portion
62, 63, 162, 362 stopper plate
141*c* vertical portion (inner end portion)
S1, S2 auxiliary air chamber

The invention claimed is:

1. A bolster beam for use with a railcar bogie to support a car body of a railcar through a pair of air springs, the bolster beam comprising:

a bolster beam main body including an upper wall and a lower wall and extending in a car width direction, a pair of auxiliary air chambers in the bolster beam main body, the pair of auxiliary air chambers to communicate with the air springs; and a stopper structure including a stopper plate, the stopper plate projecting upward from a car width direction middle portion of the bolster beam main body and to restrict positional displacement of the bolster beam relative to the car body in the car width direction within a predetermined range, wherein:

the upper wall of the bolster beam main body includes a middle upper wall portion at the stopper structure, and a pair of outside upper wall portions adjacently located at both respective car width direction sides of the middle upper wall portion and joined to the middle upper wall portion;

the pair of outside upper wall portions include respective upward bent portions that are located at a car width direction middle region and bent upward toward the stopper structure;

the stopper structure includes a cover plate including an opening that is open in a vertical direction, the cover plate including downward bent portions that are bent downward at car width direction sides of the opening;

inner end portions of the pair of outside upper wall portions are joined to the middle upper wall portion, the inner end portions being located closer to the stopper structure portion than the corresponding upward bent portions; and portions of the cover plate are joined to the middle upper wall portion, the portions of the cover plate being located closer to the corresponding outside upper wall portions than the corresponding downward bent portions.

2. The bolster beam according to claim 1, wherein the cover plate includes:

a horizontal plate which extends in the horizontal direction and on which the opening is formed;

the downward bent portions provided at both respective car width direction end portions of the horizontal plate portion; and outer end portions extending from the downward bent portions to the corresponding outside upper wall portions and joined to the middle upper wall portion, wherein each of the outer end portions of the cover plate is on a same straight line as a corresponding one of the inner end portions of the outside upper wall portions.

3. The bolster beam according to claim 1, wherein:

each of normal lines of end surfaces, located at the middle upper wall portion, of the pair of outside upper wall portions contains a vertically upward component; and the middle upper wall portion is on the end surfaces of the pair of outside upper wall portions, and joined to the pair of outside upper wall portions.

4. A bolster beam for use with a railcar bogie to support a car body of a railcar through a pair of air springs, the bolster beam comprising:

a bolster beam main body including an upper wall and a lower wall and extending in a car width direction, a pair of auxiliary air chambers in the bolster beam main body, the pair of auxiliary air chambers to communicate with the air springs;

a stopper structure including a stopper plate, the stopper plate projecting upward from a car width direction middle portion of the bolster beam main body and to restrict positional displacement of the bolster beam relative to the car body in the car width direction within a predetermined range, wherein:

the upper wall of the bolster beam main body includes:

a middle upper wall portion at the stopper structure, and a pair of outside upper wall portions adjacently located at both respective car width direction sides of the middle upper wall portion and joined to the middle upper wall portion, the pair of outside upper wall portions include respective upward bent portions that are located at a car width direction middle region and bent upward toward the stopper structure, inner ends of the pair of outside upper wall portions are joined to the middle upper wall portion, the inner end portions being located closer to the stopper structure than the corresponding upward bent portions, the bolster beam further comprises a partition joining the middle upper wall portion to the lower wall and separating the pair of auxiliary air chambers from each other, the middle upper wall portion includes a first part joined to the partition; and a pair of second parts provided at car width direction sides of the first part and joined to the outside upper wall portions, the stopper plate is joined to the first part so as to project upward from the first part; and the middle upper wall portion has such a shape that the first part is located lower than the second parts.

5. The bolster beam according to claim 4, wherein:

the first part of the middle upper wall portion extends in the horizontal direction; and the second parts of the middle upper wall portion extend diagonally upward from the first part to both respective car width direction sides.

* * * * *